US008263892B2

(12) United States Patent
Nufer et al.

(10) Patent No.: US 8,263,892 B2
(45) Date of Patent: Sep. 11, 2012

(54) GAS-INSULATED HIGH-VOLTAGE SWITCH

(75) Inventors: Juerg Nufer, Niederglatt (CH); Martin Kriegel, Ehrendingen (CH); Olaf Hunger, Schaffhausen (CH); Peter Diggelmann, Oerlikon (CH)

(73) Assignee: ABB Technology AG, Zürich (SE)

( * ) Notice: Subject to any disclaimer, the term of this patent is extended or adjusted under 35 U.S.C. 154(b) by 117 days.

(21) Appl. No.: 12/951,388

(22) Filed: Nov. 22, 2010

(65) Prior Publication Data

US 2011/0120975 A1 May 26, 2011

(30) Foreign Application Priority Data

Nov. 24, 2009 (EP) ..... 09176813

(51) Int. Cl.
*H01R 33/88* (2006.01)

(52) U.S. Cl. ..... 218/62

(58) Field of Classification Search ..... 218/62–65
See application file for complete search history.

(56) References Cited

U.S. PATENT DOCUMENTS

| | | | | |
|---|---|---|---|---|
| 3,835,274 | A * | 9/1974 | Marin | 218/48 |
| 4,161,636 | A * | 7/1979 | Maier | 218/59 |
| 4,467,158 | A * | 8/1984 | Kobayashi et al. | 218/57 |
| 5,105,058 | A * | 4/1992 | Perret | 218/65 |
| 5,155,313 | A * | 10/1992 | Dufournet et al. | 218/62 |
| 5,742,017 | A * | 4/1998 | Perret | 218/143 |
| 6,271,494 | B1 | 8/2001 | Dienemann et al. | |
| 6,437,273 | B2 * | 8/2002 | Stechbarth et al. | 218/3 |
| 6,462,295 | B1 * | 10/2002 | Knobloch et al. | 218/48 |
| 2008/0257866 | A1 | 10/2008 | Ozil et al. | |

FOREIGN PATENT DOCUMENTS

| | | |
|---|---|---|
| EP | 0809268 A2 | 11/1997 |
| EP | 1983538 A1 | 10/2008 |

OTHER PUBLICATIONS

European Search Report dated Mar. 24, 2010, for European Application No. 09176813.5.

* cited by examiner

*Primary Examiner* — Truc Nguyen
(74) *Attorney, Agent, or Firm* — Buchanan Ingersoll & Rooney PC

(57) ABSTRACT

A high-voltage switch contains two contact members, which can be moved relative to one another along an axis, a nozzle for blowing out a switching arc with quenching gas, and a stationary direction-changing transmission, which is connected to the nozzle and to the second contact member. The nozzle has a hollow insulating body, and a metallic annular body which is arranged at a blowing-out end of the nozzle, is connected in a formfitting manner to the insulating body, and supports an input or output drive element of the direction-changing transmission. This switch can be manufactured easily and at low cost, and provides good mechanical and electrical characteristics. The annular body has a concentrically arranged intermediate ring, which causes the form fit with the insulating body, and a ring, which is pushed onto the intermediate ring and is attached to the intermediate ring, for supporting the input-drive or output-drive element.

24 Claims, 3 Drawing Sheets

GAS-INSULATED HIGH-VOLTAGE SWITCH

RELATED APPLICATIONS

This application claims priority under 35 U.S.C. §119 to European Patent Application No. 09176813.5 filed in Europe on Nov. 24, 2009, the entire content of which is hereby incorporated by reference in its entirety.

FIELD

The present disclosure relates to a gas-insulated high-voltage switch.

BACKGROUND INFORMATION

A switch of the above-mentioned type can generally constitute a circuit breaker, which handles disconnection currents of more than 10 kA in a voltage range above 70 kV. A switch such as this has a switch housing which is filled with an insulating gas, which has arc quenching characteristics, for example, based on sulfur hexafluoride, nitrogen and/or carbon dioxide, generally at a pressure of up to several bar. In order to achieve rapid dielectric strength recovery of a breaker gap, which is formed between two opening contact members during disconnection of a current, the contact members are driven in opposite directions to one another. The force required to do this is applied by a single drive in the switch. A direction-changing transmission is therefore fitted to an insulating nozzle in the switch. The insulating nozzle is attached to a first one of the two contact members. This transmission transmits force, which has been introduced into the first contact member from the drive, to the second contact member, or else, vice versa, transmits force, which has been introduced into the second contact member from the drive, to the first contact member. The force which occurs in this case is considerable. The attachment of the nozzle to the first contact member is relatively simple, since the contact member has a centrally positioned arcing contact and a hollow rated current contact which coaxially surrounds the arcing contact and in which the first of the two ends of the nozzle can be fastened in a dielectrically safe manner. Since the nozzle is arranged such that the nozzle can move with respect to the second contact member, the coupling of the direction-changing transmission to the second end of the nozzle, which is used for blowing out quenching gas, is relatively complex, not least because gas-tightness and the control of the electrical field in the area of the coupling point must also be taken into account here.

A switch of the type mentioned initially is described in EP 0 809 268 A2 and U.S. Pat. No. 6,271,494 B1. In this switch, the force of the switch drive is introduced into a first contact member, to which an insulating nozzle is fitted, and is transmitted via a direction-changing transmission to the second contact member, which is driven in the opposite direction to the first contact member. As described in EP 0 809 268 A2, the insulating nozzle has an external bead, which is arranged at the blowing-out end of the nozzle and behind which a first clamping ring is latched in. A second clamping ring is arranged in front of the bead and supports the first clamping ring and/or the end of the nozzle, to prevent the first clamping ring from being unlocked. A drive element for the direction-changing transmission can be coupled to at least one of the two clamping rings. In order to allow the first clamping ring to latch in, the first claiming ring or the end of the nozzle must be elastically deformable. However, in general, this requires slots in the nozzle end or in the first clamping ring, which are positioned along the switch axis and adversely affect the gas-tightness and the dielectric strength. Additional means are therefore required, such as a field electrode to control the electrical field in the area of the coupling.

In a switch of the type mentioned initially, which is described in EP 1 983 538 A1, the force of the switch drive is introduced into the second contact member and is transmitted via a direction-changing transmission and an insulating nozzle to the first contact member, to which the nozzle is fitted and which is driven in the opposite direction to the second contact member. An annular body is arranged at the blowing-out end of the insulating nozzle, which is fitted with a drive element of the direction-changing transmission, and is attached to an external bead on the nozzle with the aid of a screw connection.

SUMMARY

An exemplary embodiment provides a gas-insulated high-voltage switch. The exemplary switch includes two contact members configured to be moved relative to one another along an axis. The exemplary switch also includes a nozzle, which is attached to a first one of the two contact members, and which is configured to blow out a switching arc with quenching gas. In addition, the exemplary switch includes a stationary direction-changing transmission which is connected to the nozzle and to the second one of the contact members. The nozzle includes a hollow insulating body, which forms a constriction and at least one section of a diffuser. The section of the diffuser is adjacent to the constriction. The nozzle also includes a metallic annular body which is arranged at a blowing-out end of the nozzle, which is connected in a formfitting manner to the insulating body and which supports one of an input drive element and an output drive element of the direction-changing transmission. The annular body of the nozzle includes a concentrically arranged intermediate ring, which causes the form fit with the insulating body, and a supporting ring for supporting the one of the input drive element and the output drive element. The supporting ring is pushed onto the intermediate ring and is attached to the intermediate ring.

BRIEF DESCRIPTION OF THE DRAWINGS

Additional refinements, advantages and features of the present disclosure are described in more detail below with reference to exemplary embodiments illustrated in the drawings, in which.

In the drawings, the same reference symbols denote the same or similarly functioning components. A summary of the reference symbols used in the drawings is provided in the below list of reference of symbols.

DETAILED DESCRIPTION

Figure 1:
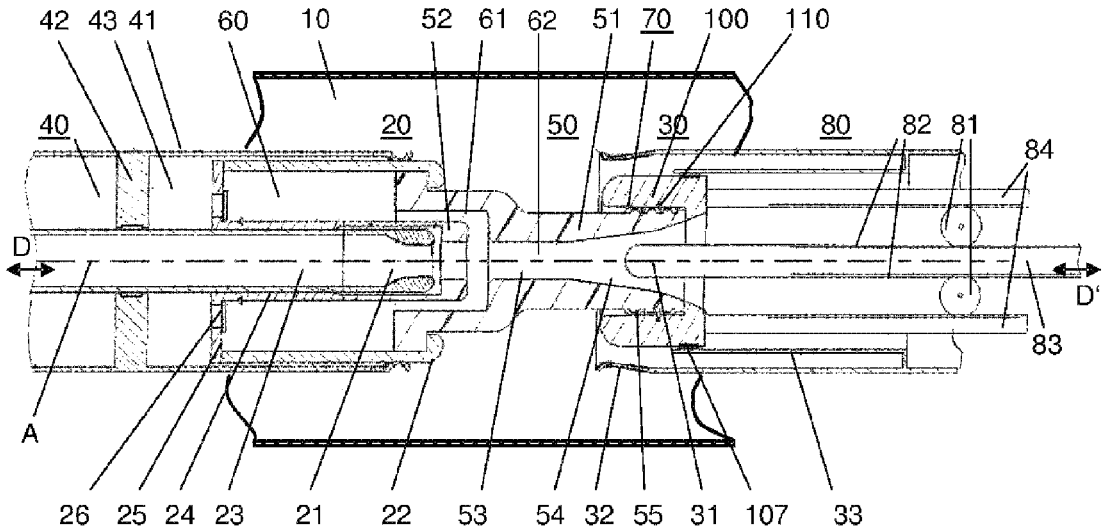
FIG. 1 shows a plan view of a section, along an axis A, through an exemplary embodiment of an open high-voltage switch according to the present disclosure.

Exemplary embodiments of the present disclosure provide a gas-insulated high-voltage switch which can be manufactured easily and at low cost, and which possesses good mechanical and electrical characteristics.

An exemplary embodiment of the present disclosure provides a gas-insulated high-voltage switch that includes two contact members, which can be moved relative to one another along an axis, a nozzle, which is attached to a first of the two contact members, for blowing out a switching arc with quenching gas, and a stationary direction-changing transmission which is connected on the one hand to the nozzle and on the other hand to the second contact member. The nozzle includes a hollow insulating body which forms a constriction and at least one section of a diffuser, which section is adjacent to the constriction. The nozzle also includes a metallic annular body which is arranged at a blowing-out end of the nozzle, which is connected in a formfitting manner to the insulating body and which supports an input drive element or an output drive element of the direction-changing transmission. The annular body has a concentrically arranged intermediate ring, which causes the form fit with the insulating body, and a supporting ring for supporting the input or output drive element, which supporting ring is pushed onto the intermediate ring and which is attached to the intermediate ring.

According to an exemplary embodiment, an annular outer groove, which is positioned around the axis, can be formed in the outer surface of the intermediate ring, and an annular inner groove, which is positioned around the axis, can be formed in an inner surface of the supporting ring, which rests on the outer surface of the intermediate ring with virtually no play (e.g., firmly situated). The two grooves are arranged and designed such that, in the event of any relative movement of the supporting ring and intermediate ring along the axis during the manufacture of the switch, a circlip, which is arranged in the outer groove or in the inner groove, can spread into the inner groove or into the outer groove, forming a connection between the supporting ring and the intermediate ring which is secured against axial movements.

According to an exemplary embodiment, the inner surface of the supporting ring can end in a conically widening insertion profile at its end facing the first contact member, which insertion profile reduces the diameter of the circlip, due to elastic deformation during the relative movement of the supporting ring and the intermediate ring before the circlip spreads in.

According to an exemplary embodiment, an annular step which extends radially inward can be formed in the inner surface of the supporting ring and have an annular surface, which forms the step height, which is seated on an end surface of the insulating body, which end surface is provided at the blowing-out end of the nozzle. The annular step can form a section of the diffuser and have an inner surface which widens conically toward the blowing-out end of the nozzle.

According to an exemplary embodiment, the intermediate ring can be slotted and have a longitudinal joint, which is aligned predominantly axially and allows the intermediate ring to spread out during manufacture of the switch. The intermediate ring can be formed from a plurality of parts and can have at least two annular parts which are separated from one another by longitudinal joints which extend predominantly axially. The external profile of the insulating body can have at least one raised area or depression, which is positioned in an annular shape around the axis and into which a depression or raised area, which is designed to be largely congruent, on the intermediate ring is fitted. The at least one raised area, which is positioned in an annular shape around the axis, on the insulating body, can extend along the axis, over at least half of the axial extent of the intermediate ring.

According to another exemplary embodiment, the intermediate ring can also have no joints and be screwed to the insulating body, wherein the screw connection has an internal thread, which is formed in the inner surface of the intermediate ring, and an external thread, which is formed in the envelope surface of the insulating body. A bead can be formed in a section of the envelope surface of the insulating body adjacent to the external thread, positioned in an annular shape around the axis, and snapped into an inner groove, which is formed in the inner surface of the intermediate ring.

According to an exemplary embodiment, a field electrode, which has no joints and surrounds the intermediate ring, can be formed in the supporting ring, or can be fitted to the supporting ring.

According to an exemplary embodiment, a seal which surrounds the supporting ring can be fitted on the outer surface of the supporting ring, in order to protect rated current contacts of the two contact members against the influence of arc gases.

Figure 2:
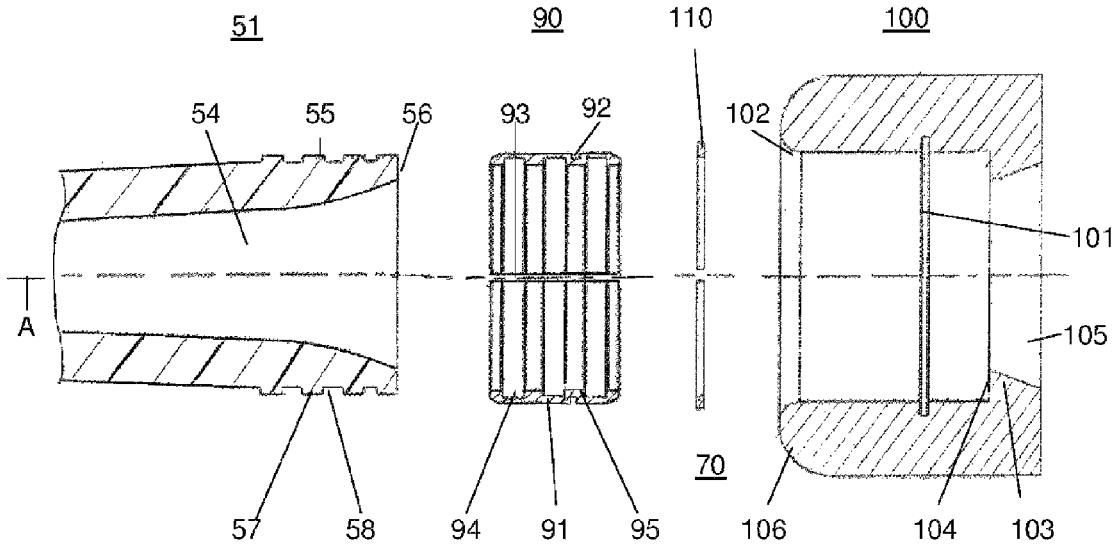
FIG. 2 shows an exploded illustration of a first exemplary embodiment of a force transmitting element for the high-voltage switch shown in FIG. 1.

FIGS. 1 and 2 illustrate a high-voltage switch according to an exemplary embodiment of the present disclosure. The high-voltage switch illustrated in FIGS. 1 and 2 is in the form of a circuit breaker and contains a switch housing 10. The housing 10 is largely tubular and is filled with a compressed insulating gas, such as sulfur hexafluoride or a gas mixture containing sulfur hexafluoride, for example. The housing 10 has a largely axially symmetrical contact arrangement which is accommodated in the housing 10 and which has two contact members 20 and 30 which can be moved relative to one another along an axis A.

The contact member 20 has, arranged coaxially, a hollow arcing contact 21 and a hollow rated current contact 22, which surrounds the hollow arcing contact 21. On the other hand, the contact member 30 has, arranged coaxially, an arcing contact 31, which is in the form of a pin, and a hollow rated current contact 32, which surrounds the arcing contact 31.

The contact member 20 is positioned in a gas-tight manner along the axis A, such that the contact member 20 slides in a stationary, metallic hollow body 40, and is connected via a hollow contact support 23 of the arcing contact 21 to an insulator of a switch drive D, which is at ground potential.

The hollow body 40 contains an axially aligned, stationary hollow cylinder 41, which coaxially surrounds the rated current contact 22 and is bounded on the left (in the example of FIG. 1) along the axis A by a stationary cylinder base 42. An opening is provided in the cylinder base, in which the hollow contact support 23 for the arcing contact 21 is mounted in a gas-tight manner, while still being able to move axially.

A sleeve 24 is mounted on the outer surface of the contact support 23 and is fitted at its end facing the contact member 30 with an auxiliary nozzle 52, which contains an insulating material, such as PTFE, for example, and surrounds the arcing contact 21. A wall 25, which is positioned radially on the outside and on whose outer rim the rated current contact 22 is fixed, is located at the end of the auxiliary nozzle 52 facing the drive D. The end of the rated current contact 22 which faces the contact member 30 is fitted on its inside with a hollow insulating body 51, which can contain PTFE, for example, and has a constriction 53 and at least one section, adjacent to the constriction, of a diffuser 54 of a nozzle 50. The sleeve 24, the wall 25, the rated current contact 22 and the end of the insulating body 51 which is held in the rated current contact 22 bound a heating volume 60 for holding hot, ionized gas, which is formed by a switching arc that occurs when the switch is opened. The heating volume 60 communicates via a heating channel 61, which is bounded by the insulating body 51 and the auxiliary nozzle 52, with an arcing zone 62, which holds the switching arc and is bounded radially by the constriction and the diffuser of the nozzle 50 and axially by the two opened arcing contacts 21 and 31. A metallic annular body 70 is arranged at a blowing-out end of the nozzle 50, which is formed by the diffuser 54, and is connected in an interlocking manner to the insulating body 51, which has an external profile 55.

The hollow cylinder 41, the cylinder base 42, the contact support 23 and the wall 25 of the sleeve 24 bound a compression area 43 in a piston-cylinder compression apparatus having (i) a fixed hollow cylinder, which is formed by the hollowing cylinder 41 and the cylinder base 42, and having (ii) a piston, which is formed by the contact support 23 and the wall 25 and is moved by the drive D. The compression area 43 communicates with the heating volume 60 via a non-return valve 26, which is arranged in the wall 25, when the pressure in the compression area 43 is equal to or greater than the pressure in the heating volume 60. If the pressure in the compression area 43 is less than the filling pressure of the insulating gas in the switch housing 10 when the switch is closed, fresh insulating gas is passed from the switch housing 10 into the compression area 43 via a non-return valve arranged in the cylinder base 42.

Gas which is stored in the heating volume 60 and in the compression area 43 is passed through the heating channel 61 into the arcing zone 62 when the switch is opened, and blows out the switching arc, as a result of which, when the current to be disconnected approaches a zero crossing, ionized arc gas is removed from the arcing zone 62 through the blowing-out opening in the nozzle 50, and through the hollow contact support 23.

The reference symbol 80 denotes a direction-changing transmission for the switch, which is mounted such that it is fixed. This transmission 80 contains two gearwheels 81, which are mounted such that they are fixed, and on the one hand each engage in one of two toothed rods 82. The toothed rods 82 are integrated in an output-drive element of the direction-changing transmission 80, in each case on one of two surfaces which are arranged opposite, and the output-drive element is in the form of a rod 83 and is rigidly connected to the arcing contact 31. On the other hand, the gearwheels 81 each, however, also engage in one of two toothed rods 84, which are arranged such that they can be moved axially in the opposite direction to the rod 83. The toothed rods 84 are rigidly connected to the annular body 70. Since the annular body 70 is connected to the insulating body 51 in an interlocking manner, and since the drive D of the switch transmits force to the toothed rods 84 via the contact member 20, the insulating body 51 and the annular body 70, these act as an input-drive element for the direction-changing transmission 80.

According to an exemplary embodiment, the direction-changing transmission 80 may also be in the form of a lever transmission. The change in the direction of the force is then achieved by a two-armed lever, which is mounted such that it is fixed, with a rod which acts as an input-drive element for the direction-changing transmission being articulated, for example, on one of the arms of this lever, and with a rod which acts as an output-drive element for the direction-changing transmission being articulated, for example, on the other arm of this lever.

According to an exemplary embodiment, instead of being introduced via the contact member 20, the drive force can also be introduced into the contact arrangement of the switch via the direction-changing transmission 80. If the direction-changing transmission 80 is, for example, a toothed rod transmission, then the rod 83 can be driven by a drive, which is annotated D' in FIG. 1, and then no longer acts as an output-drive element, but as an input-drive element, for the direction-changing transmission 80. In a corresponding manner, the toothed rods 84 then do not act as an input-drive element but as an output-drive element for the direction-changing transmission 80, and transmit drive force via the nozzle 50 to the contact member 20. When the switch is being opened, the respective drive D or D' has to apply the force to accelerate the contact members 20, 30, the nozzles 50 and 52 and the direction-changing transmission 80, and to compress the insulating gas which is located in the compression area 43. Since considerable forces are transmitted via the nozzle 50 in this case, the interlocking connection of the insulating body 51 to the annular body 70 should be extremely robust.

The annular body 70 which can be seen in the exemplary embodiment illustrated in FIG. 2 is therefore formed from a plurality of parts and, with respect to the axis A, has a concentrically arranged intermediate ring 90, which produces the interlock with the insulating body 51, as well as a supporting ring 100, which is pushed onto the intermediate ring 90 and secures the interlock, for fitting the toothed rods 84, which act as an input-drive element or as an output-drive element for the direction-changing transmission 80. According to an exemplary embodiment, the intermediate ring 90 can be manufactured from a hard material which can be elastically deformed well, such as steel, e.g., a spring steel. The interlock to the insulating body 51 is achieved by an internal profile 91, which is formed in the inside of the intermediate ring 90 and engages in the external profile 55, with the interlock thus allowing the insulating body 51 and the intermediate ring 90 to be connected such that they are secured against axial movement. In order to ensure the interlock, the rigid supporting ring 100, which can be composed of steel, for example, is pushed onto the intermediate ring 90. The supporting ring 100 can be connected considerably more easily to the intermediate ring 90 than the intermediate ring to the insulating body 51, and can also be mounted on the intermediate ring 90, such that the supporting ring 100 can pivot about the axis A, while still transmitting force well in the axial direction. This pivotable bearing allows switch parts to be adjusted more easily and to be connected to one another more easily during manufacture of the switch. Furthermore, the surface of the supporting ring 100 which faces away from the toothed rods 84 may be in the form of a field electrode without any joints, which can, effectively, electrically shield the triple point formed by the insulating body 51, the annular body 70 and the insulating gas, and prevent undesirable electrical field peaks on the surface of the insulating body 51. At the same time, the supporting ring 100 supports the intermediate ring 90 radially on the outside, and thus prevents the intermediate ring 90 from widening, and therefore also prevents the interlock from being reduced or canceled.

As can be seen in the exemplary embodiment illustrated in FIG. 2, an annular outer groove 92, which is positioned around the axis A, is formed in the outer surface of the intermediate ring 90. This groove 92 is used to hold a circlip 110. After being introduced into the groove 92, the circlip spreads out, and is then fixed in the groove 92 in the axial direction. An annular inner groove 101, which is positioned around the axis A, is formed in an inner surface of the supporting ring 100, which rests on the outer surface of the intermediate ring 90.

When the switch is being manufactured, the end of the supporting ring 100 which faces away from the blowing-out end of the nozzle 50 is pushed onto the intermediate ring 90, which has already been arranged on the insulating body 51. At its end to be pushed on, the inner surface of the supporting ring 100 ends in an insertion profile 102, which widens conically. The diameter of the circlip 110 is therefore reduced by elastic deformation during the pushing-on process. As soon as the circlip 110 is located above the inner groove 101, the circlip 110 snaps into the groove 101, with its diameter increasing, and in the process secures the supporting ring 100 against axial movement. Alternatively, the circlip 110 can be first spread into the inner groove 101, and the supporting ring 100, with the circlip 110 spread into the groove 101, can then be pushed over the intermediate ring 90, which has already been arranged on the insulating body 51, during which process the circlip 110, which is fixed axially in the inner groove 101, snaps into the outer groove 92, and in the process secures the supporting ring against axial movement.

According to an exemplary embodiment, an annular step 103, which extends radially inward and has an annular surface 104 which governs the height of the step 103, can be formed in the inner surface of the supporting ring 100. The annular step 103 is arranged such that an end surface 56 of the insulating body 51, which is provided at the blowing-out end of the nozzle 50, rests on the annular surface 104 of the annular step 103 when the circlip 110 snaps into the inner groove 101. This seating removes the load of the interlocking connection of the insulating body 51 to the annular body 70 during switching processes, during which the insulating body 51 is pressure-loaded by the force introduced by the drive. In the case of a switch in which the drive D acts directly on the contact support 23, this load relief occurs during closure, and in the case of a switch in which the force of the drive D' is introduced directly into the input-drive element of the direction-changing transmission (rod 83), the load relief occurs, in contrast, during opening. Since, during opening, the drive D' has to transmit the force required to compress the insulating gas located in the compression area 43, it is particularly advantageous to remove the load of the interlocking connection of the insulating body 51 to the annular body 70 in a switch which has the drive D'.

As can be seen from FIG. 1, the annular step 103 also forms a section of the diffuser 54, and has an inner surface 105 which widens conically toward the blowing-out end of the nozzle 50.

According to an exemplary embodiment, in order to simplify the arrangement of the intermediate ring 90 on the insulating body 51, the intermediate ring 90 can be slotted and have a predominantly axially aligned longitudinal joint 93, as can be seen in the exemplary embodiment of FIG. 2. During manufacture of the switch, the intermediate ring 90 is spread open transversely with respect to the longitudinal joint 93, and is then spread into the external profile 55. The spreading process is not required if the intermediate ring 90 is formed from two or more parts and has a number of longitudinal joints corresponding to the number of annular parts, allowing the annular parts to be inserted directly into the external profile 55.

According to an exemplary embodiment, in order to achieve a good force transmission, the external profile 55 on the insulating body 51 has at least one raised area 57 or depression 58, which is positioned in an annular shape around the axis A, and into which a depression 94 or raised area 95, which is largely congruent, on the intermediate ring 90 is fitted. As can be seen in the exemplary embodiment illustrated in FIG. 2, the external profile 55 has a comb-like structure, which is produced by a plurality of raised areas 57 and depressions 58. Because of this structure, the force to be transmitted is introduced into the insulating body 51, and distributed uniformly via the external profile 55.

Figure 3:
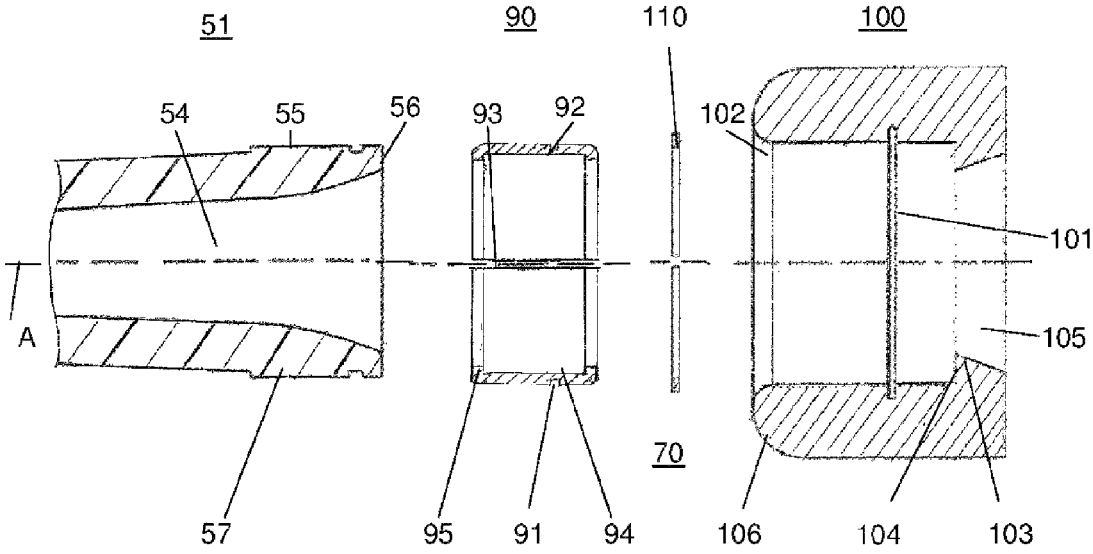
FIG. 3 shows another exemplary embodiment, which is modified in comparison to the first exemplary embodiment illustrated in FIG. 2, of the force transmitting element.

As can be seen from the exemplary embodiment shown in FIG. 3, it is sufficient for the insulating body 51 to have only one raised area 57, which is positioned in an annular shape around the axis A, and engages in the intermediate ring 90, which has only one depression 94. If, as is illustrated in the exemplary embodiment of FIG. 3, the raised area 57 extends along the axis A over at least half of the axial extent of the intermediate ring 90, then this results in the insulating body 51 having a large effective shear area, and therefore also in a high-strength interlocking connection between the insulating body 51 and the annular body 70.

Figure 4:
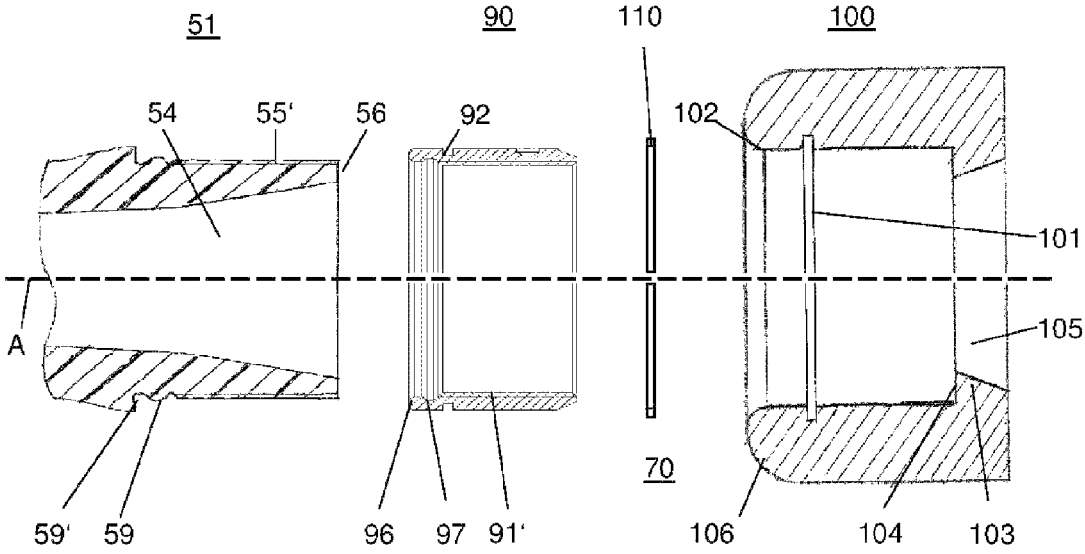
FIG. 4 shows a third exemplary embodiment, which is modified in comparison to the first and second exemplary embodiments illustrated in FIGS. 2 and 3, respectively, of the force transmitting element.

As an alternative to the exemplary embodiments of the annular body 70 illustrated in FIGS. 2 and 3, the intermediate ring 90 may also be designed without any joints. As can be seen in the exemplary embodiment illustrated in FIG. 4, the intermediate ring 90 can then be screwed to the insulating body 51. The screw connection in this case has an internal thread 91', which corresponds to the internal profile 91 and is likewise formed in the inner surface of the intermediate ring 90. An external thread 55', which is formed in the envelope surface of the insulating body 51 to correspond to the external profile 55, is screwed into this internal thread. A supporting ring 100, which is otherwise designed to correspond to the embodiments shown in FIGS. 2 and 3, can then, as already described, be fixed axially with the aid of the circlip 110, which has been spread into the grooves 92 and 101. A bead 59, which is positioned in an annular shape around the axis A, is formed into a section of the envelope surface of the insulating body 51 adjacent to the external thread 55', and is larger than the end 96 of the intermediate ring 90 which is guided when the intermediate ring 90 is being screwed onto the bead 59. As the screwing-on process continues, the end 96 is passed over the bead 59, and in the process elastically deforms the bead 59. Toward the end of the screwing-on process, the load on the bead 59 is removed again, and the bead 59 snaps into an inner groove 97, which is adjacent to the end 96 and is formed in the inside of the intermediate ring 90. At the same time, the end 96 of the intermediate ring strikes a stop 59', which is formed in the envelope surface of the insulating body 51 and ends the screwing-on process. The expansion of the bead 59 into the inner groove 97 prevents the intermediate ring 90, which has been fixed to the insulating body 51 by the screwing-on process, from being released. The supporting ring 100 can then be mounted on the intermediate ring 90 such that the supporting ring 100 can still pivot about the axis A.

Figure 5:
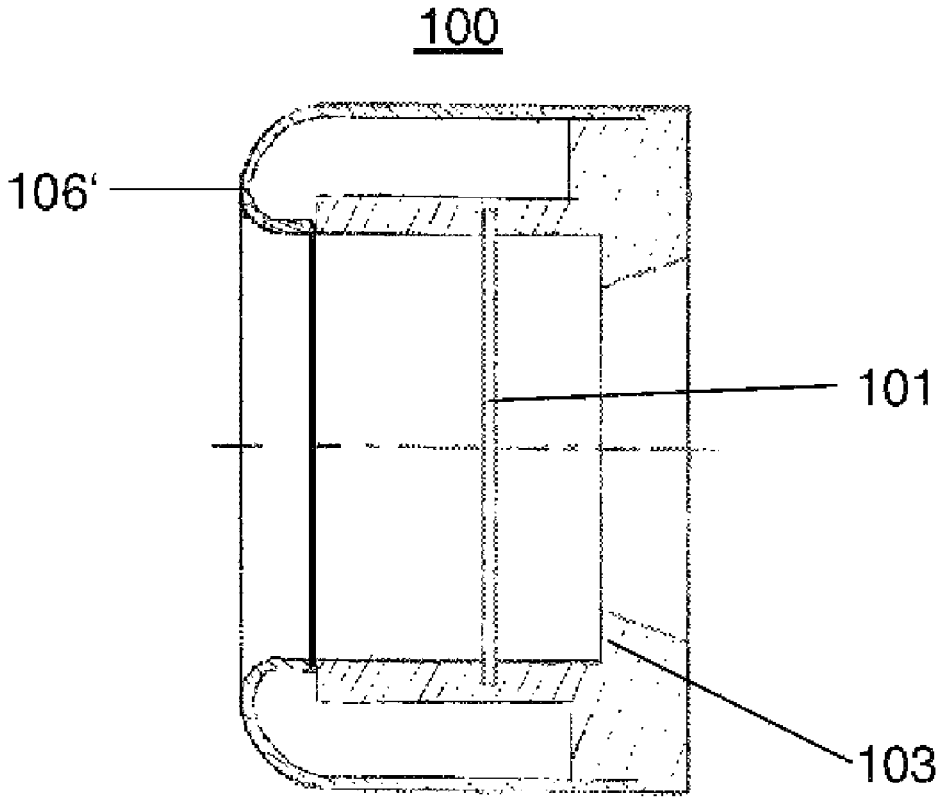
FIG. 5 shows an exemplary embodiment of a supporting ring which can be used in any one of the exemplary force transmitting elements illustrated in FIGS. 2 to 4.

In each of the exemplary embodiments discussed above, the supporting ring 100 surrounds the intermediate ring 90, the supporting ring 100 has no joints, and is also provided with a smooth surface, which acts as a field electrode. The supporting ring 100 therefore prevents expansion of the slotted intermediate ring, and therefore also firmly holds the intermediate ring 90, which is formed from a plurality of parts, together. At the same time, the supporting ring 100 covers all the longitudinal joints in the intermediate ring 90, thus preventing the intermediate ring 90 from having any influence on the control of the electrical field which acts in the switch. As is illustrated in the exemplary embodiments of FIGS. 2 to 4, the field is controlled by a field electrode 106 which is formed directly in the supporting ring, but this can also be achieved by a hollow field electrode 106' fitted onto the supporting ring 100, as shown in the exemplary embodiment of FIG. 5. The use of a field electrode such as this reduces the moving mass during a switching process, and correspondingly reduces the size of the respective drive D or D'.

In order to prevent hot gas which is formed by the switching arc in the arcing zone 62 during a switching process from reaching the rated current contacts 22, 32, a seal 107, which surrounds the supporting ring 100 and can be seen in FIG. 1, for example, is fitted to the outer surface of the supporting ring 100. During a switching process, the seal 107 slides on a hollow-cylindrical shield 33, which is arranged in the rated current contact 32 and is rigidly connected to rated current contact 32. Hot gas emerging from the arcing zone 62 is then passed through the hollow contact support 23 and through the nozzle 50 and the shield 33, which is connected to the nozzle 50 in a gas-tight manner, just into areas of the switch housing 10 which are well away from the rated current contacts 22, 32.

It will be appreciated by those skilled in the art that the present disclosure can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Switch housing
20 Contact member
21 Arcing contact
22 Rated current contact
23 Contact support of the arcing contact 21
24 Sleeve
25 Wall
26 Non-return valve
30 Contact member
31 Arcing contact
32 Rated current contact
33 Shield
40 Hollow body
41 Hollow cylinder
42 Cylinder base
43 Compression area
50 Nozzle
51 Insulating body
52 Auxiliary nozzle
53 Constriction in the nozzle 50
54 Diffuser of the nozzle 50
55 External profile
55' External thread
56 End surface
57 Raised area
58 Depression
59 Bead
59' Stop
60 Heating volume
61 Heating channel
62 Arcing zone
70 annular body
80 Direction-changing transmission
81 Gearwheels
82, 84 Toothed rods
83 Rod
90 Intermediate ring
91 Internal profile
91' Internal thread
92 Outer groove
93 Longitudinal joint
94 Depression
95 Raised area
96 End of the intermediate ring 90
97 Inner groove
100 Supporting ring
101 Inner groove
102 Insertion profile
103 Annular step
104 Annular surface
105 Inner surface
106, 106' Field electrode
107 Seal
110 Circlip
A Axis
D, D' Switch drives

What is claimed is:

1. A gas-insulated high-voltage switch comprising:

two contact members configured to be moved relative to one another along an axis;

a nozzle, which is attached to a first one of the two contact members, and configured to blow out a switching arc with quenching gas; and a stationary direction-changing transmission which is connected to the nozzle and to the second one of the contact members, wherein:

the nozzle comprises a hollow insulating body, which forms a constriction and at least one section of a diffuser, the section being adjacent to the constriction;

the nozzle further comprises a metallic annular body which is arranged at a blowing-out end of the nozzle, which is connected in a formfitting manner to the insulating body and which supports one of an input drive element and an output drive element of the direction-changing transmission; and the annular body of the nozzle comprises a concentrically arranged intermediate ring, which causes the form fit with the insulating body, and a supporting ring for supporting the one of the input drive element and the output drive element, the supporting ring being pushed onto the intermediate ring and being attached to the intermediate ring.

2. The switch as claimed in claim 1, comprising:

an annular outer groove which is positioned around the axis and which is formed in an outer surface of the intermediate ring;

an annular inner groove which is positioned around the axis and which is formed in an inner surface of the supporting ring, the annular inner groove resting on the outer surface of the intermediate ring with virtually no play; and a circlip arranged in one of the outer groove and the inner groove, wherein the outer groove and the inner groove are arranged such that, in case of any relative movement of the supporting ring and the intermediate ring along the axis during manufacture of the switch, the circlip is configured to spread into one of the inner groove and the outer groove, and form a connection between the supporting ring and the intermediate ring which is secured against axial movements.

3. The switch as claimed in claim 2, wherein the inner surface of the supporting ring ends in a conically widening insertion profile at an end supporting ring facing the first contact member, the insertion profile reducing the diameter of the circlip due to elastic deformation during the relative movement of the supporting ring and the intermediate ring before the circlip spreads in.

4. The switch as claimed in claim 1, comprising:

an annular step which extends radially inward and which is formed in the inner surface of the supporting ring, the annular step having an annular surface, which forms the step height, which is seated on an end surface of the insulating body, wherein the end surface of the insulating body is provided at the blowing-out end of the nozzle.

5. The switch as claimed in claim 4, wherein the annular step forms a section of the diffuser and has an inner surface which widens conically toward the blowing-out end of the nozzle.

6. The switch as claimed in claim 1, wherein the intermediate ring is slotted and has a longitudinal joint, which is aligned predominantly axially and allows the intermediate ring to spread out during manufacture of the switch.

7. The switch as claimed in claim 1, wherein the intermediate ring is formed from a plurality of parts and has at least two annular parts which are separated from one another by longitudinal joints which extend predominantly axially.

8. The switch as claimed claim 6, wherein an external profile of the insulating body has at least one raised area or depression, which is positioned in an annular shape around the axis and into which a depression or raised area, which is designed to be largely congruent, on the intermediate ring is fitted.

9. The switch as claimed in claim 8, wherein the at least one raised area, which is positioned in an annular shape around the axis, on the insulating body extends along the axis, over at least half of the axial extent of the intermediate ring.

10. The switch as claimed in claim 1, wherein the intermediate ring is free of joints and is screwed to the insulating body, wherein the screw connection has an internal thread, which is formed in the inner surface of the intermediate ring, and an external thread, which is formed in the envelope surface of the insulating body.

11. The switch as claimed in claim 10, comprising:

a bead which is formed in a section of the envelope surface of the insulating body adjacent to the external thread, is positioned in an annular shape around the axis, and is snapped into an inner groove, the inner groove being formed in the inner surface of the intermediate ring.

12. The switch as claimed in claim 1, comprising:

a field electrode, which is free of joints and surrounds the intermediate ring, the field electrode being one of formed in the supporting ring and fitted to the supporting ring.

13. The switch as claimed in claim 1, comprising:

a seal which surrounds the supporting ring and which is fitted on the outer surface of the supporting ring, to protect rated current contacts of the two contact members against an influence of arc gases.

14. The switch as claimed in claim 3, comprising:

an annular step which extends radially inward and which is formed in the inner surface of the supporting ring, the annular step having an annular surface, which forms the step height, which is seated on an end surface of the insulating body, wherein the end surface of the insulating body is provided at the blowing-out end of the nozzle.

15. The switch as claimed in claim 14, wherein the annular step forms a section of the diffuser and has an inner surface which widens conically toward the blowing-out end of the nozzle.

16. The switch as claimed in claim 3, wherein the intermediate ring is slotted and has a longitudinal joint, which is aligned predominantly axially and allows the intermediate ring to spread out during manufacture of the switch.

17. The switch as claimed in claim 3, wherein the intermediate ring is formed from a plurality of parts and has at least two annular parts which are separated from one another by longitudinal joints which extend predominantly axially.

18. The switch as claimed claim 7, wherein an external profile of the insulating body has at least one raised area or depression, which is positioned in an annular shape around the axis and into which a depression or raised area, which is designed to be largely congruent, on the intermediate ring is fitted.

19. The switch as claimed in claim 18, wherein the at least one raised area, which is positioned in an annular shape around the axis, on the insulating body extends along the axis, over at least half of the axial extent of the intermediate ring.

20. The switch as claimed in claim 3, wherein the intermediate ring is free of joints and is screwed to the insulating body, wherein the screw connection has an internal thread, which is formed in the inner surface of the intermediate ring, and an external thread, which is formed in the envelope surface of the insulating body.

21. The switch as claimed in claim 20, comprising:

a bead which is formed in a section of the envelope surface of the insulating body adjacent to the external thread, is positioned in an annular shape around the axis, and is snapped into an inner groove, the inner groove being formed in the inner surface of the intermediate ring.

22. The switch as claimed in claim 12, comprising:

a field electrode, which is free of joints and surrounds the intermediate ring, the field electrode being one of formed in the supporting ring and fitted to the supporting ring.

23. The switch as claimed in claim 3, comprising:

a field electrode, which is free of joints and surrounds the intermediate ring, the field electrode being one of formed in the supporting ring and fitted to the supporting ring.

24. The switch as claimed in claim 1, comprising:

a seal which surrounds the supporting ring and which is fitted on the outer surface of the supporting ring, to protect rated current contacts of the two contact members against an influence of arc gases.

* * * * *